US008711137B2

(12) United States Patent
Fang et al.

(10) Patent No.: US 8,711,137 B2
(45) Date of Patent: Apr. 29, 2014

(54) LIQUID CRYSTAL DISPLAY DEVICE WITH A CONTROL MECHANISM FOR ELIMINATING IMAGES

(75) Inventors: Wen-Chen Fang, Taipei (TW); Chun-Chin Tseng, Taipei (TW); Wen-Zhe Lin, Taipei (TW); Pei-Chi Tsai, Taipei (TW)

(73) Assignee: Hannstar Display Corporation, Taipei (TW)

( * ) Notice: Subject to any disclaimer, the term of this patent is extended or adjusted under 35 U.S.C. 154(b) by 1179 days.

(21) Appl. No.: 12/354,844

(22) Filed: Jan. 16, 2009

(65) Prior Publication Data

US 2010/0097365 A1 Apr. 22, 2010

(30) Foreign Application Priority Data

Oct. 17, 2008 (TW) ..... 97140037 A

(51) Int. Cl.
*G09G 5/00* (2006.01)

(52) U.S. Cl.
USPC ..... 345/212; 345/87; 345/102

(58) Field of Classification Search
USPC ..... 345/212; 399/212
See application file for complete search history.

(56) References Cited

U.S. PATENT DOCUMENTS

| | | | | |
|---|---|---|---|---|
| 5,808,693 | A * | 9/1998 | Yamashita et al. | 348/554 |
| 6,587,101 | B2 * | 7/2003 | Yoo | 345/211 |
| 6,621,489 | B2 * | 9/2003 | Yanagisawa et al. | 345/211 |
| 6,677,937 | B1 * | 1/2004 | Takahashi et al. | 345/212 |
| 6,678,834 | B1 * | 1/2004 | Aihara et al. | 713/501 |
| 2003/0085859 | A1 * | 5/2003 | Lee | 345/87 |
| 2003/0112211 | A1 * | 6/2003 | Hector | 345/87 |
| 2005/0036078 | A1 * | 2/2005 | Tsunashima et al. | 349/38 |
| 2005/0231491 | A1 * | 10/2005 | Yeh | 345/204 |
| 2007/0126686 | A1 * | 6/2007 | Chang et al. | 345/98 |
| 2008/0158126 | A1 | 7/2008 | Tung | |

* cited by examiner

*Primary Examiner* — William Boddie
*Assistant Examiner* — Andrew Schnirel
(74) *Attorney, Agent, or Firm* — Ming Chow; Sinorica, LLC

(57) ABSTRACT

The present invention discloses a liquid crystal display device and a control method thereof. In the present invention, a clock controller detects an external clock signal and outputs a switching signal according to the external clock signal. According the information carried by the switching signal, a shutoff switching circuit controls a gamma voltage generator and a common voltage circuit to output voltages making a pixel electrode and a common electrode have a zero voltage difference. Thereby, the pixel charges are completely released after system shutoff, and the shutoff retained images are instantly eliminated.

18 Claims, 8 Drawing Sheets

LIQUID CRYSTAL DISPLAY DEVICE WITH A CONTROL MECHANISM FOR ELIMINATING IMAGES

BACKGROUND OF THE INVENTION

1. Field of the Invention

The present invention relates to an LCD device and an LCD control method, particularly to an LCD device free of retained images and a control method thereof.

2. Description of the Related Art

Because of slimness, lightweight, no radiation, low power consumption, long service life, soft images and ocular health, LCD (Liquid Crystal Display) has high market share in many application fields. Among LCDs, the active-matrix TFT LCD is the mainstream of the market.

Refer to FIG. 1 for a conventional TFT LCD driver circuit. In a LCD panel 10, there is a plurality of arrayed pixels 11, and each pixel 11 has a TFT (Thin Film Transistor) 12 functioning as a switch. The gate of the TFT 11 is connected to a horizontal scan line 13, and the drain is connected to a vertical data line 14, and the source is connected to the electrodes (such as the pixel electrode) of a liquid-crystal capacitor 8 and a storage capacitor 9, wherein the other electrodes (such as the common electrode) of the liquid-crystal capacitor 8 and the storage capacitor 9 are connected to a common voltage Vcom (the Cs-on-common type). In another type of LCD panel (not shown in the drawings), the other electrode of the liquid-crystal capacitor 8 is connected to a common voltage Vcom, and the other electrode of the storage capacitor is connected to a horizontal scan line 13 (the Cs-on-gate type). The data lines 14 are driven by a source driver 15, and the scan lines 13 are driven by a gate driver 16. Refer to FIG. 2. An LCD display device 23 comprises an LCD panel 10 and a control system driving the LCD panel 10. In the LCD device 23, an input interface 17 provides power source for a DC (Direct Current) power converter 18, and then the DC power converter 18 provides working voltages for a gamma voltage generator 19, a clock controller (Tcon IC) 21 and a common voltage circuit 20. The gamma voltage generator 19 outputs a reference voltage to a source driver 15. The source driver 15 generates a gray-level voltage to the pixel electrode of a pixel in the LCD panel 10 according to the reference voltage and a pixel data signal from the clock controller 21. The common voltage circuit 20 generates a common voltage Vcom to the common electrode of the pixel. Thus, a voltage drop is created between two sides of the liquid crystal capacitor to twist the liquid crystal molecules and create an image. The clock controller 21 controls the operations of the gate driver 16 and the source driver 15 according to the pixel data signal and an external clock signal provided by the input interface 17. Thereby, the control system can control the pixels 11 of the LCD panel 10 to operate according to data signals and present images on the LCD panel 10.

In detail, the gate of TFT LCD turns on or turns off to charge or discharge the pixel electrode of the crystal liquid capacitor. When a voltage high enough (such as Vgh) is applied to a scan line, all the gates on the scan line are turned on, and the related data lines respectively write the corresponding pixel gray-level voltages into the pixel electrodes at the same time. After an appropriate charging time, a voltage small enough (such as Vgl) is applied to the scan line to turn off all the gates on the scan line, and the charges of the pixel electrodes are kept for a period of time. Such a design is the so-called holding type display. In normal operation, the gate is turned on and off persistently, and the pixel data is also renewed constantly. When the LCD display is switched off (or shut off) by user, all the voltages of the control system become zero. Thus, all the gates on the scan lines no more turn on, and the pixel electrodes keep the voltages of the last image until the charges are completely released by natural current leakage. As the charges of the pixel electrodes are released slowly and unevenly, retained images appear on the screen of the LCD panel. Thus, the screen turns from black to pale, and the retained images appear in different positions and have different areas and diverse chroma. The retained images phenomenon depends on the charge keeping capability of the pixel.

At present, a reset IC 22 is arranged in between the input interface 17 and the gate driver 16 to solve problem of retained images. In the instant of switching off LCD, the reset IC 22 detects the voltage variation of Vdd. The Vdd variation will trigger the reset IC 22 to set the XAO signal to a low level. According to the XAO signal, the gate driver 16 makes all the scan lines output a Vgh voltage to turn on all the gates of TFT at the same time. Thus, the charges of the pixel electrodes of all the pixels on the LCD panel 10 are released via the data lines to accelerate the disappearance of retained images.

In another solution, a clock controller (Tcon IC) is used to detect the turning off of the LCD display device, and then black images are sequentially insert into the rows of pixels; after the liquid crystal of the liquid crystal capacitors of all the pixels on the panel has been twisted to an identical angle, the charges are released. Thus is also solved the problem of retained images.

The abovementioned reset IC can indeed solve the problem of retained images. However, it increases the material cost. Besides, the inrush current will be very high in turning off the system because all the scan lines output voltage Vgh at the same time. The inrush current makes electric punctures likely to occur between the Vgh pads and the conductive bumps of COG IC. Further, turning off and turning on the LCD device within a short interval of time results in a power-dip problem. Moreover, the method of sequentially writing black images into pixel rows also has problems of slow retained image elimination and uneven discharging rates of pixels.

Accordingly, the present invention proposes an LCD device and a control method thereof to effectively eliminate retained images.

SUMMARY OF THE INVENTION

The primary objective of the present invention is to provide an LCD device and a control method thereof, which uses a shutoff switching circuit to achieve that the data electrode and the common electrode have the same voltage in system shutoff, whereby pixel charges can be completely released after system shutoff, and whereby the shutoff retained images can be instantly eliminated.

Another objective of the present invention is to provide an LCD device and a control method thereof, which does not adopt the problematic conventional method that uses a reset IC to send out a low-level XAO signal to the gate driver to make all the scan lines output a Vgh voltage to turn on all the gates of TFT at the same time, wherefore the present invention can reduce the fabrication cost and is exempted from the power dip of the reset IC and the electric puncture caused by a voltage surge of Vgh.

A further objective of the present invention is to provide an LCD device and a control method thereof, which continues using the existing clock controller to detect a shutoff signal, wherefore the present invention can realize the intended function without greatly varying the existing architecture of the conventional LCD device.

To achieve the abovementioned objectives, the present invention proposes an LCD device, which comprises a clock control, a power converter, and a shutoff switching circuit. The clock controller detects an external clock signal and outputs a switching signal to the shutoff switching circuit according to the external clock signal. The power converter provides a first working voltage for the clock controller and also provides a second working voltage. The shutoff switching circuit is coupled to the clock controller and receives the second working voltage. According to information contained by the switching signal, the shutoff switching circuit controls a gamma voltage generator and a common voltage circuit to output voltages to make a pixel electrode and a common electrode of a pixel has a zero voltage difference.

The present invention also proposes a method for controlling a liquid crystal display device, which comprises steps: respectively providing a first working voltage and a second working voltage for a clock controller and a shutoff switching circuit; using the clock controller to detect whether there is an external clock signal and output a switching signal to the shutoff switching circuit according to the detection result; and according to the switching signal, making a gamma voltage generator and a common voltage circuit to respectively generate a first reference voltage and a first common voltage, or making the gamma voltage generator and the common voltage circuit to respectively generate a second reference voltage and a second common voltage, wherein the second reference voltage and the second common voltage make a pixel electrode and a common electrode of a pixel has a zero voltage difference, whereby the voltage across each liquid crystal capacitor becomes zero.

Below, the embodiments are described in detail in cooperation with the attached drawings to make easily understood the objectives, technical contents, characteristics and accomplishments of the present invention.

DETAILED DESCRIPTION OF THE INVENTION

The difference of the discharging speeds of the pixel electrode voltage and the common voltage (Vcom) is the main factor resulting in retained images. The pixel electrode voltage discharges more slowly than the common voltage, which results in the variation of the voltages across the liquid crystal capacitors during discharging. The voltage variation of the liquid crystal capacitors results in the variation of the light transmission rates, which makes us perceive retained images. The present invention uses a clock controller (such as Tcon IC) and a shutoff switching circuit to supply an identical voltage as the pixel electrode voltage and the common voltage, whereby the voltage across two electrodes of the liquid crystal capacitor becomes zero, and retained images are eliminated.

Figure 1:
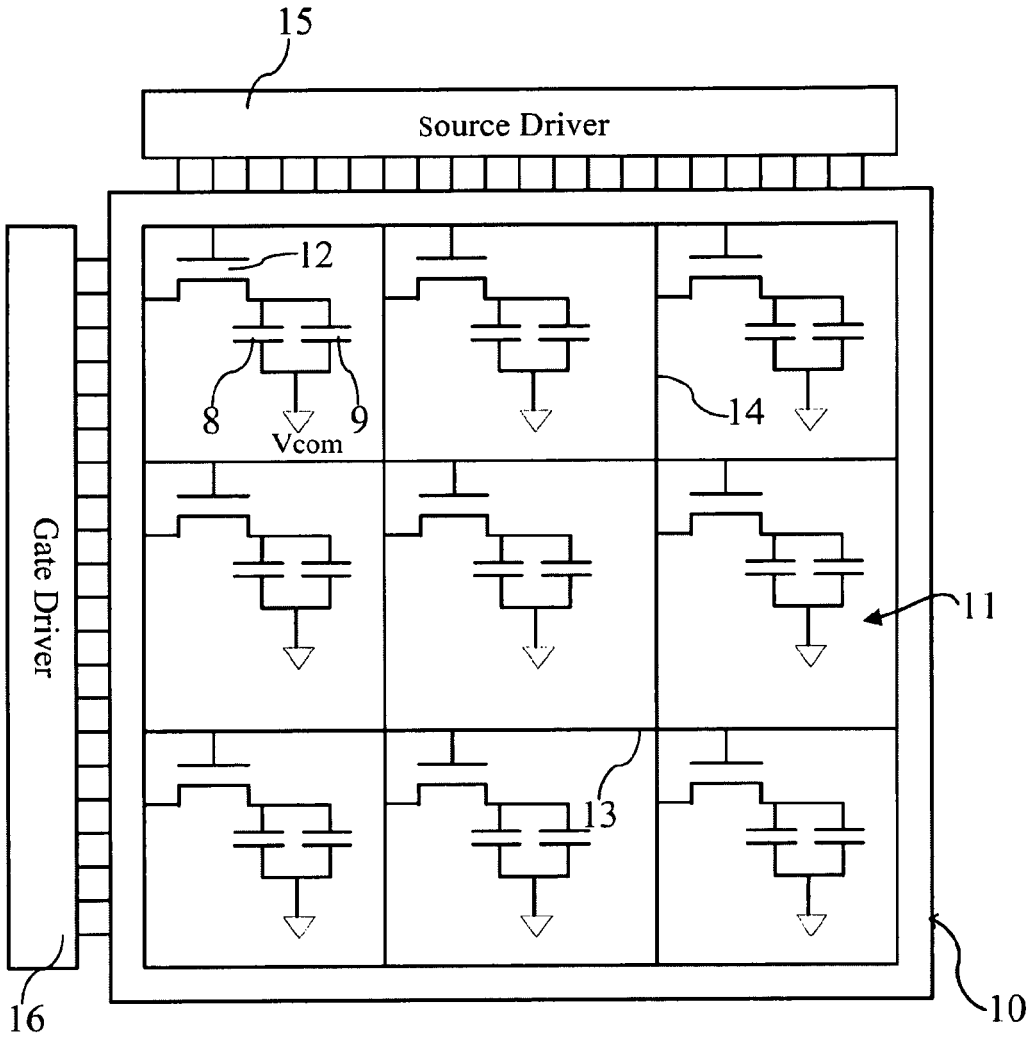
Fig. 1 (Prior Art)
FIG. 1 is a diagram schematically showing the circuit of a conventional LCD device.
Figure 2:
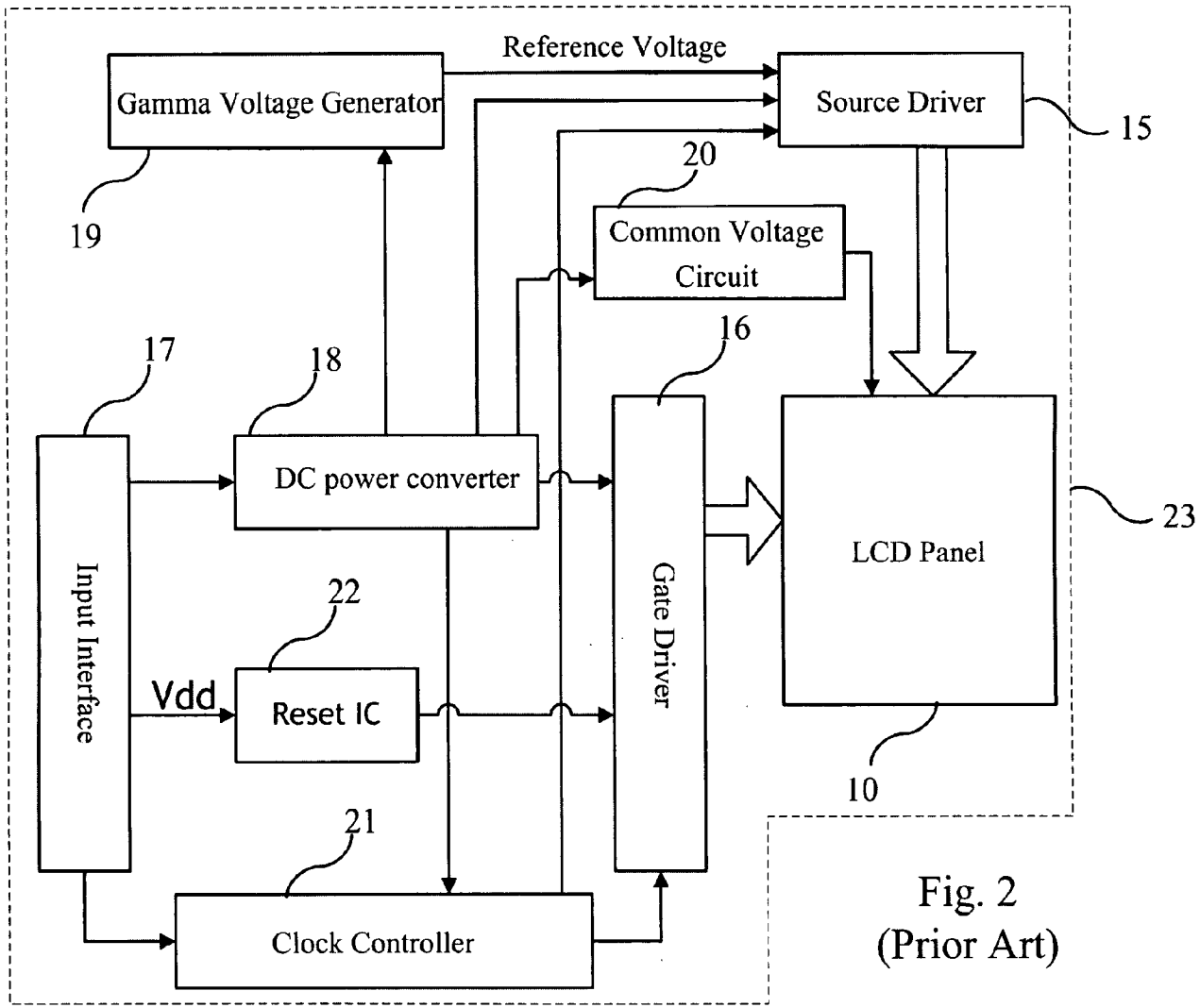
Fig. 2 (Prior Art)
FIG. 2 is a block diagram schematically showing the circuit of a conventional technology for solving the problem of retained images.
Figure 3:
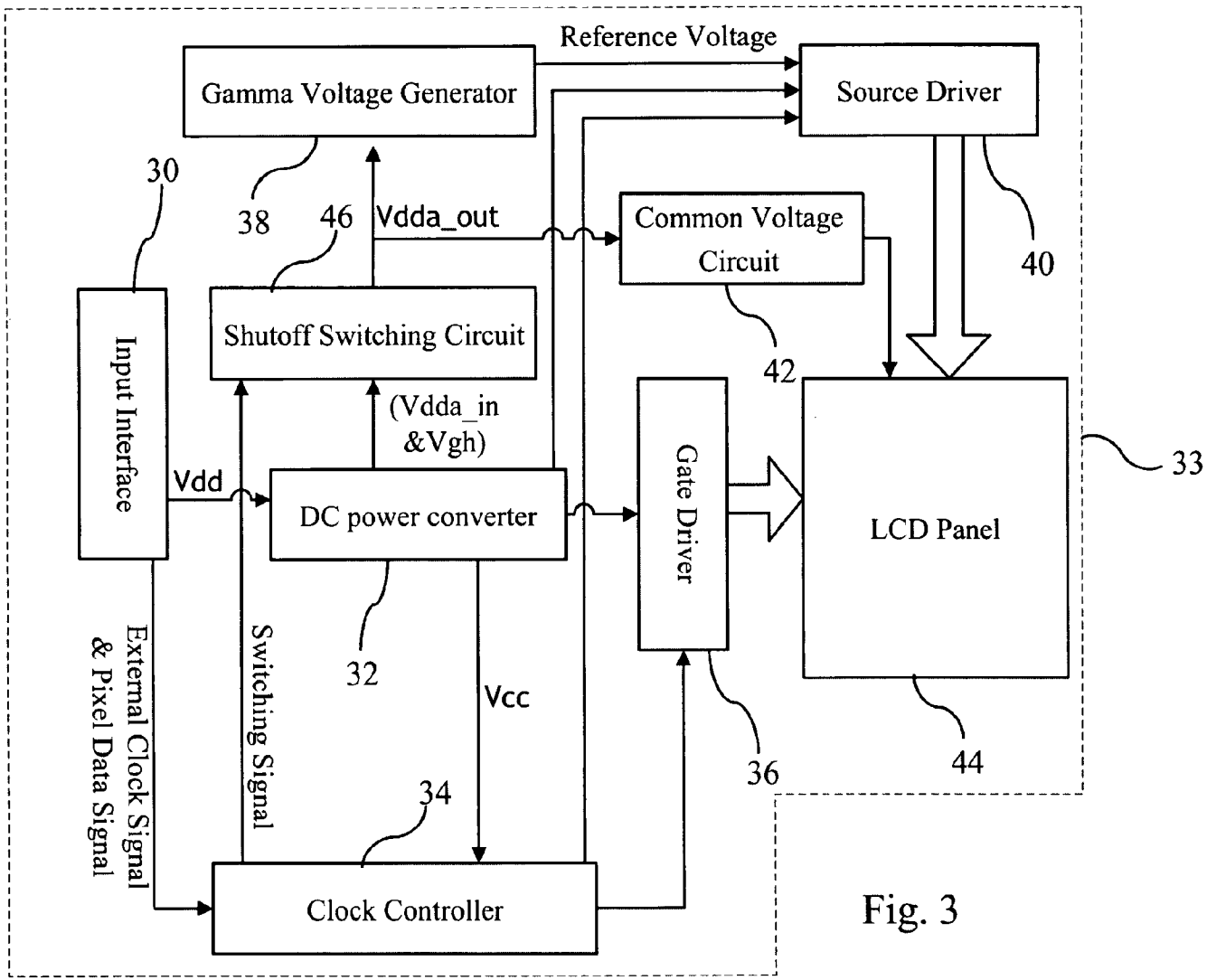
FIG. 3 is a block diagram schematically showing a control device according to the present invention.

Refer to FIG. 3 a block diagram schematically showing the control device according to the present invention. The control device of an LCD device 33 comprises an input interface 30, a DC power converter 32, a clock controller 34, a gamma voltage generator 38, a common voltage circuit 42, and a shutoff switching circuit 46. The input interface 30 provides a voltage source Vdd for the DC power converter 32, and the DC power converter 32 converts the voltage source into the working voltages the related elements require. The clock controller 34 receives an external clock signal and a pixel data signal via the input interface 30 and controls a gate driver 36 and a source driver 40. Generally to speak, the external clock is contained by a differential signal, such as LVDS (Low Voltage Differential Signal), or RSDS (Reduced Swing Differential Signal), or a TTL (Transistor-Transistor Logic) signal. The clock controller 34 generates a switching signal according to whether it detects (or receives) an external clock signal. The gamma voltage generator 38 generates a reference voltage (including one or several voltages) to the source controller 40, and then the source controller 40 generates a gray-level voltage to the corresponding pixel electrode according to the pixel data signal. The common voltage circuit 42 generates a common voltage (Vcom) to all pixels of an LCD panel 44. The input terminal of the shutoff switching circuit 46 is connected to the clock controller 34 and the DC power converter 32, and the output terminal of the shutoff switching circuit 46 is connected to the gamma voltage generator 38 and the common voltage circuit 42. Thus, the gamma voltage generator 38 and the common voltage circuit 42 are coupled to the DC power converter 32 via the shutoff switching circuit 46 to obtain the operating voltages they need. The shutoff switching circuit 46 is controlled by a switching signal of the clock controller 34. When an external clock signal is input to the LCD device (i.e. the LCD device is turned on), or when the clock controller 34 detects an external clock signal, the clock controller 34 sends out a switching signal to control the shutoff switching circuit 46 to output a first control voltage (Vdda_out in FIG. 3) to the gamma voltage generator 38 and the common voltage circuit 42. Thereby, the gamma voltage generator 38 and the common voltage circuit 42 respectively generate a reference voltage and a common voltage. According to the reference voltage and a pixel data signal, the source driver 40 generates a gray-level voltage to the corresponding pixel electrode, whereby the pixel can present an image. When the clock controller 34 does not detect an external clock signal (for example, the external clock signal is abnormal or weak) from the input interface, or when the external clock signal is not be provided to input to the LCD device (for example, the LCD device is turned off by the user or due to a certain condition), the clock controller 34 controls the shutoff switching circuit 46 to output a second control voltage (Vdda_out in FIG. 3) to the gamma voltage generator 38 and the common voltage circuit 42. Thereby, the gamma voltage generator 38 and the common voltage circuit 42 respectively generate a reference voltage and a common voltage. According to the reference voltage, the source driver 40 generates a gray-level voltage equal to the common voltage for the corresponding data lines. Thus, the voltage across the liquid crystal capacitor becomes zero, and the shutoff retained images are fast eliminated.

Figure 4:
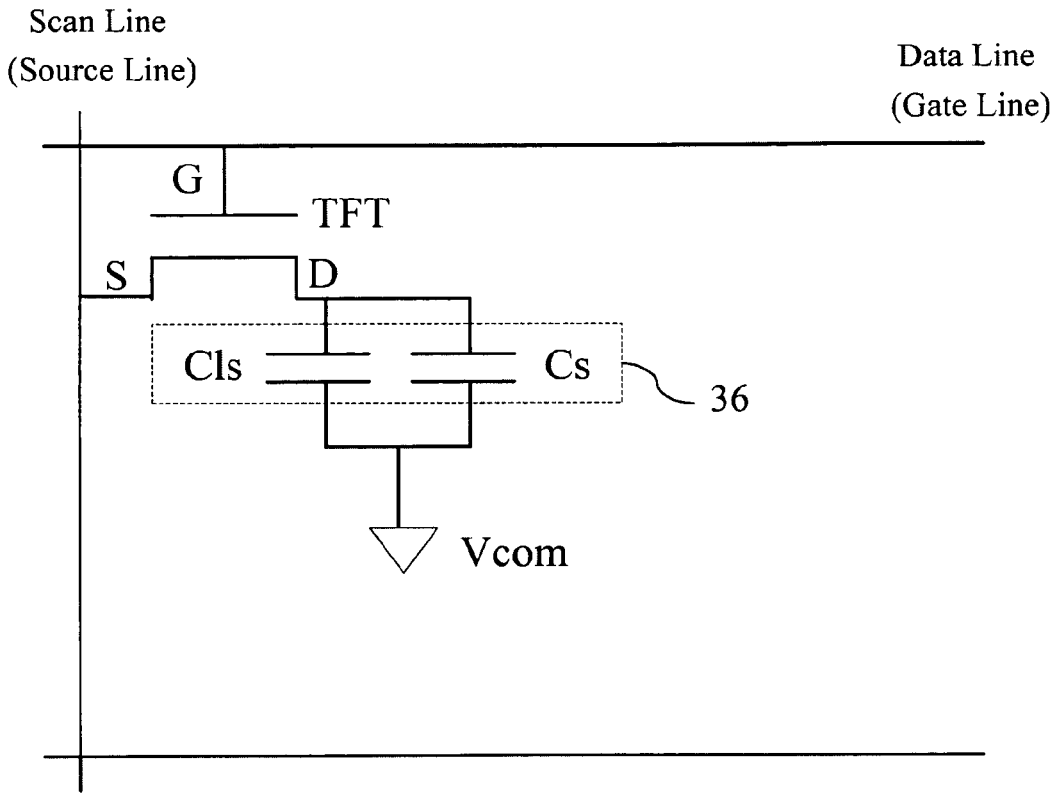
FIG. 4 is a diagram schematically showing an equivalent circuit of a pixel.

In detail, when the input interface 30 of the LCD device 33 receives the external clock signal and a pixel data signal and transmits the external clock signal and the pixel data signal to the clock controller 34, the clock controller 34 detects that an external clock signal exists or that an external clock signal is inputted to the LCD device 33. After receiving the external clock signal, the clock controller 34 outputs a control signal having a first level voltage to the shutoff switching circuit 46; then the shutoff switching circuit 46 is powered by a working voltage (such as Vdda_in) of the DC power converter 32 and sends out a first control voltage (Vdda_out) to the gamma voltage generator 38 and the common voltage circuit 42. The gamma voltage generator 38 and the common voltage circuit 42 receive the first control voltage (Vdda_out) as the working voltages thereof and respectively generate a reference voltage to the source driver 40 and a common voltage to a common electrode of the LCD panel 44. When the clock controller 34 does not detect the existence of an external clock signal or when the external clock signal is not inputted to the LCD device 33, the clock controller 34 outputs a control signal having a second level voltage to the shutoff switching circuit 46. Then, the shutoff switching circuit 46 outputs a second control voltage (Vdda_out) to the gamma voltage generator 38 and the common voltage circuit 42 as the working voltages thereof. Preferably, the second control voltage can be of zero volts (a ground voltage). Refer to FIG. 4 for an equivalent circuit of a pixel. Suppose that both the gamma voltage generator 38 and the common voltage circuit 42 receive a voltage of zero volts (i.e. the shutoff switching circuit 46 outputs a Vdda_out of zero volts). Thus, the voltage-division resistor of the gamma voltage generator 38 generates a reference voltage of zero volts. Once the source driver 40 receives the zero-volt reference voltage, the voltage-division circuit of the source driver 40 also generates a zero-volt gray-level voltage to the corresponding data line. Thus, a zero-volt voltage is written into the pixel electrodes. At the same time, the common voltage circuit also has a working voltage of zero volts and outputs a zero-volt common voltage. As both the gray-level voltage and the common voltage are of zero volts, both the pixel electrodes and the common electrodes have a voltage of zero volts. In other words, the voltage across the liquid crystal capacitor of each pixel is of zero volts no matter what the shutoff picture is. Thus, the pixel charges are promptly and completely released, and the retained images are fast eliminated. It should be particularly mentioned herein: although the Cs-on-common pixel structure is used as the exemplification in FIG. 4, the present invention is not limited to the exemplification. The control architecture and method of the present invention also applies to the LCD panel of the Cs-on-gate pixel structure.

Figure 5:
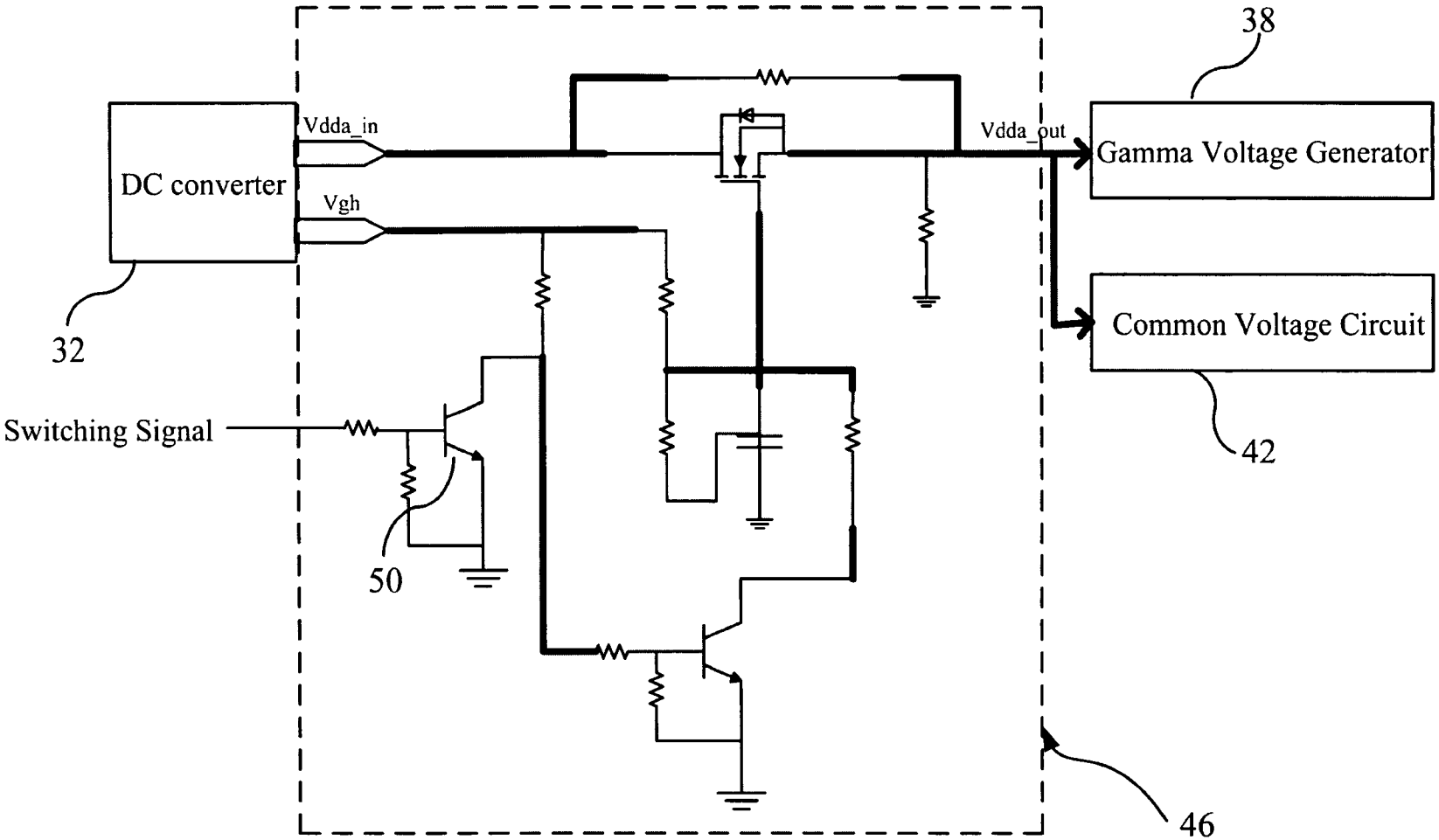
FIG. 5 is a diagram schematically showing a shutoff switching circuit according to one embodiment of the present invention.

Refer to FIG. 5 for an embodiment of the shutoff switching circuit 46, which cooperates with the clock controller 34 in the present invention. The shutoff switching circuit 46 comprises passive elements (such as simple resistors and capacitors) and transistors. The input terminal of the shutoff switching circuit 46 receives the working voltages of Vdda_in and Vgh from the DC power converter and the switching signal from the clock controller 34. According to the switching signal (such as a high-level voltage or a low-level voltage), the shutoff switching circuit 46 sends out a control voltage Vdda_out from the output terminal thereof to the gamma voltage generator 38 and the common voltage circuit 42. The values of the elements in the shutoff switching circuit 46 (such as resistors, capacitor and transistors) are not specified herein since the persons skilled in the art should be able to optimize the values according to the required Vdda_in, Vgh and Vdda_out. The shutoff switching circuit 46 is designed to output signals to control the gamma voltage generator 38 and the common voltage circuit 42 to respectively generate a corresponding reference voltage and a common voltage according to the switching signal. Therefore, the present invention does not need to alter the architecture of the control circuit of the LCD device or the existing outputs thereof but only need to add a simply shutoff switching circuit to cooperate with the existing architecture. In addition to the embodiment disclosed herein, the present invention also includes any circuit able to realize the same functions. In another embodiment, the shutoff switching circuit 46 is integrated with the DC power converter or another control element.

The control device of the present invention has been described above, and the control method of the present invention will be described in cooperation with the timing diagrams below.

Figure 6:
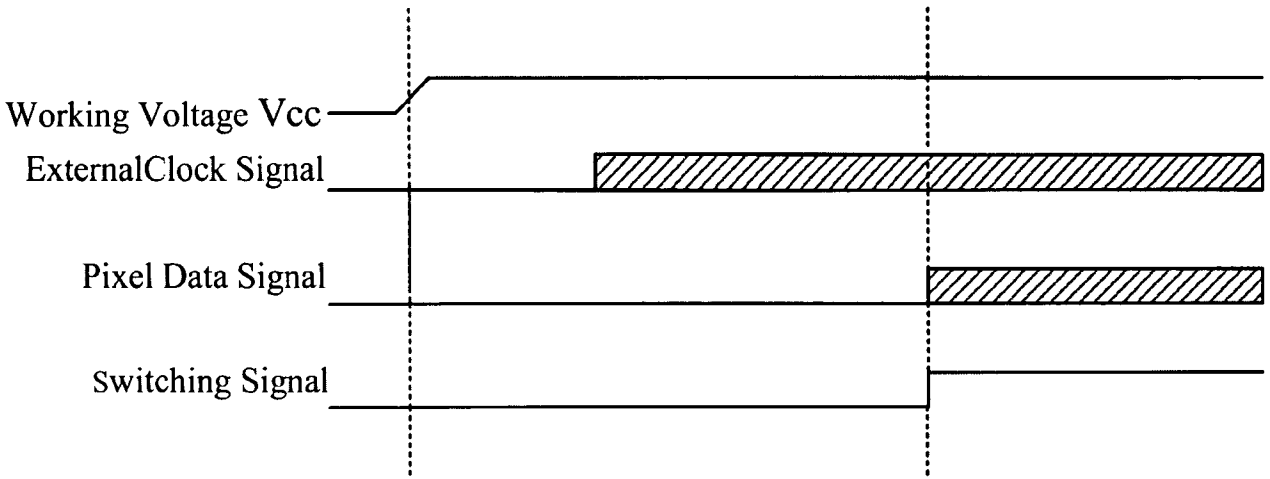
FIG. 6 is a timing diagram of a control device in turning on an LCD device according to the present invention.

Refer to FIG. 3 and FIG. 6. As the LCD device is normally turned on (the power is turned on), i.e. the clock controller 34 can detect the existence of an external clock signal, or that an external clock signal can be inputted to the LCD device, the DC power converter 32 receives an external voltage source from outside the LCD device 33 via the input interface 30. Next, the DC converter 32 provides working voltages respectively for the control elements of the LCD device, such a working voltage Vcc for the clock controller 34 and the working voltages Vdd_in and Vgh for the shutoff switching circuit 46. As shown in FIG. 6, when the LCD device is turned on, the working voltage Vcc changes from a disable state to an enable state, i.e. from a low level voltage to a high level voltage, and then the clock controller 34 receives an external clock signal and a pixel data signal from outside the LCD device. Next, the clock controller 34 transmits the pixel data signal to the source driver 40; then the source driver 40 transforms the pixel data signal into a corresponding gray-level voltage according to the received reference voltage and writes the gray-level voltage into the pixel electrode. After receiving the external clock signal and the pixel data signal, the clock controller 34 pulls the switching signal to a first level voltage, such as a high level voltage (enable voltage), and the high level voltage is maintained during the normal operation duration of the turned-on LCD device to control the shutoff switching circuit 46. Then, according to the information contained in the switching signal (such as the high level voltage), the shutoff switching circuit 46 generates a first control signal Vdd_out1 to the gamma voltage generator 38 and the common voltage circuit 42. Thus, the gamma voltage generator 38 generates a reference voltage which the source driver 40 needs for presenting a normal image in a non-shutoff state. Refer to FIG. 5 again. When the switching signal is at the high level voltage, the first control signal Vdd_out1 outputted by the shutoff switching circuit 46 is about equal to the working voltage Vdd_in received by the shutoff switching circuit 46. Once receiving the first control signal, the gamma voltage generator 38 and the common voltage circuit 42 respectively generate a reference voltage and a common voltage. After the source driver 40 receives the reference voltage, the voltage-division resistor of the source driver 40 generates a corresponding gray-level voltage to the related pixel electrode, whereby the pixel can present an image.

Figure 7:
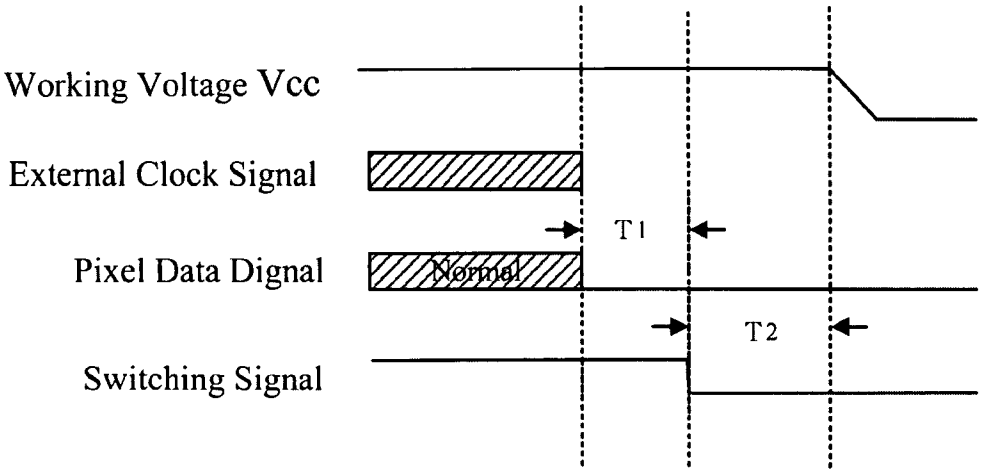
FIG. 7 is a timing diagram of a control device in turning off an LCD device according to the present invention.

Refer to FIG. 7. As the LCD device is turned off and stops generating an external clock signal, or the clock controller 34 cannot no more detect an external clock signal because the external clock signal is abnormal, i.e. as the clock controller 34 has detected the interruption of the external clock signal, the clock controller 34 will continue the detection for a time interval T1, for example, the time interval used to scan two scan lines. After the time interval T1, if the clock controller 34 still cannot detect an external clock signal, the clock controller 34 outputs a switching signal of a low level voltage to the shutoff switching circuit 46. Then, the shutoff switching circuit 46 outputs a second control voltage Vdda_out2, which is about equal to the ground voltage, i.e. zero volts. Refer to FIG. 5 again. When the switching signal is at the low level voltage (disable voltage), the switch element 50 directly connected to the switching signal is turned off, and the shutoff switching circuit 46 outputs a second control voltage Vdd_out2 having a ground voltage to the gamma voltage generator 38 and the common voltage circuit 42. After receiving the zero-volt voltage, the gamma voltage generator 38 generates a zero-volt reference voltage to the source driver 40. After the source driver 40 receives the zero-volt reference voltage, the voltage-division resistor of the source driver 40 generates a zero-volt gray-level voltage to the corresponding pixel. After receiving the zero-volt voltage, the common voltage circuit 42 generates a zero-volt common voltage to the common electrode of the liquid crystal capacitor. Thus, the two electrodes of the liquid crystal capacitor have the same voltage (such as zero volts), i.e. the voltage across the liquid crystal capacitor becomes zero. Thereby, the retained images are fast eliminated. In other words, when the LCD device is turned off, the shutoff switching circuit 46 outputs a second control voltage (such as zero volts) to the gamma voltage generator 38 and the common voltage circuit 42 according to the information contained by the switching signal (such as a low level voltage) to control the voltages output by the gamma voltage generator 38 and the common voltage circuit 42, whereby the pixel electrode and the common electrode of the pixel have a voltage drop of zero volts therebetween. It should be noted herein: the low level voltage of the switching signal should be maintained for at least time interval T2, and T2 may not be shorter than a frame scanning period (or a vertical scanning period) so that there is sufficient time to write the related signals into the liquid crystal capacitor. Further, after the LCD device is turned off, the working voltage Vcc should also be maintained at an enable state or a high level voltage until the time interval T2 is over, whereby the control device can continue to write signals (i.e. write an identical voltage, such as zero volts, to the pixel electrodes and the common electrodes).

Figure 8:
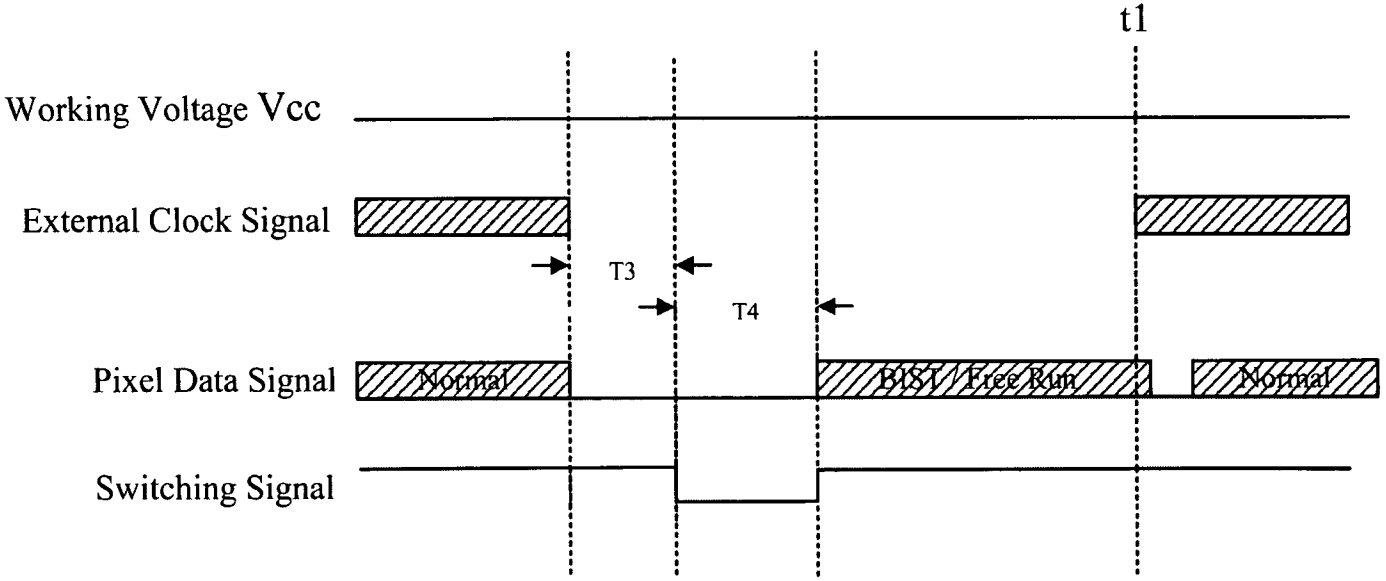
FIG. 8 is a timing diagram of a control device in a non-turn off state of an LCD device according to the present invention.

Generally, an LCD device has a BIST (Built-In Self Test)/free run function (mode) in such as the clock controller thereof. In the present invention, the additional shutoff switching circuit 46 does not interfere with but is compatible with the BIST/free run function. Refer to FIG. 8 and FIG. 3. As the clock controller 34 has detected the interruption of an external clock signal, and that the clock controller 34 still cannot detect the appearance of an external clock signal in a time interval T3 (such as the time interval used to scan two scan lines) after the interruption. The clock controller 34 outputs a switching signal having a low level voltage to the shutoff switching circuit 46. Then, the shutoff switching circuit 46 outputs a control voltage (zero volts, for example) to the gamma voltage generator 38 and the common voltage circuit 42. Thus, the gamma voltage generator 38 and the common voltage circuit 42 respectively generate a reference voltage and a common voltage. Thereby, the pixel electrode and the common electrode of the pixel have an identical voltage, i.e. the voltage across the liquid crystal capacitor of each pixel becomes zero. Suppose that the clock controller 34 has output the low-level-voltage switching signal for a time interval T4. The time interval T4, for example, is the time interval for scanning at least $(5+\alpha)$ frames, wherein $\alpha \leq 1$, and "5" may be modified according to the condition of the clock controller. If the working voltage Vcc still can be detected after the time interval T4 (for example, Vcc is still maintained at a high level voltage, as shown in FIG. 8), it indicates that the power of the LCD device is still turned on. In such a case, the clock controller 34 charges the switching signal from a low level voltage to a high level voltage, as shown in FIG. 8. At this time, the pixel data signal is supplied by the BIST/free run mode of the display device, and the pictures of the BIST/free run mode will be written into the pixels of the LCD panel 44. As the clock controller 34 detects an external clock signal again; for example, the external clock is inputted into the display device again, or the external clock signal resumes a normal waveform, after the time point t1 shown in FIG. 8. In such a case, the normal pixel data signals are supplied again. When the clock controller 34 detects an external clock signal again, the switching signal is changed to a high level voltage, and the working voltage Vcc is maintained at an enable state, whereby the system can write the normal pixel data signals into pixels.

In conclusion, the present invention features an additional shutoff switching circuit. When the system is turned off, or when the system cannot confirm whether an normal external clock signal exists, the present invention uses the shutoff switching circuit to write an identical voltage (such as zero volts) into the pixel electrodes and the common electrodes of the liquid crystal capacitors to make the voltage across the liquid crystal capacitors become zero. In the abovementioned embodiments, the identical voltage is exemplified by a voltage of zero volts. However, the present invention does not limit the identical voltage to be a voltage of zero volts. In fact, supplying any identical voltage to the pixel electrodes and the common electrodes can achieve the same function no matter what volt the identical voltage has. Therefore, the value of the identical voltage may be appropriately selected according to the design of the shutoff switching circuit. The details of the related circuit should be easily realized by the persons skilled in the art and thus will not repeat herein. As long as the voltage across the liquid crystal capacitors becomes zero, the charges of the pixel electrodes will be fast released after system shutoff, and the retained images will thus be fast eliminated. In the invention, the retained images can completely disappear in about 0.34 seconds after the system is turned off, while the retained images of a conventional LCD device still remain within 0.34-1 second after the device is turned off. The retained images of the conventional LCD device do not disappear until the system has been shut off for 1.2 seconds. Therefore, the present invention can indeed eliminate the shutoff retained images instantly.

The present invention uses an existing clock controller (Tcon IC) to detect the shutoff signal and uses only one of the pins of the clock controller to transmit the switching signal controlling the shutoff switching circuit. The present invention can realize the intended function without greatly varying the existing architecture of the conventional LCD device. Compared with the conventional technology using a reset IC to eliminate retained images, the present invention not only can greatly reduce the cost but also can obviously shorten the time to eliminate retained images. Compared with the conventional technology turning on all pixel transistors to release charges of pixel electrodes in shutting off the system, the present invention is exempted from the electric puncture caused by too high a voltage surge of Vgh.

The embodiments described above are to demonstrate the technical contents and characteristics of the present invention to enable the persons skilled in the art to understand, make, and use the present invention. However, it is not intended to limit the scope of the present invention. Any equivalent modification or variation according to the spirit of the present invention is to be also included within the scope of the present invention.

What is claimed is:

1. A liquid crystal display device comprising:

a gamma voltage generator;

a common voltage circuit;

a clock controller detecting an external clock signal and outputting a switching signal based on the detection result of the external clock signal;

a power converter coupled to said clock controller and providing a first working voltage for said clock controller;

a shutoff switching circuit coupled to said clock controller, receiving a second working voltage from said power converter, receiving said switching signal, and outputting one of a first control voltage and a second control voltage to the gamma voltage generator and the common voltage circuit according to information carried by said switching signal, to control a reference voltage output by the gamma voltage generator and a common voltage output by the common voltage circuit, making a pixel electrode and a common electrode of a pixel has a zero voltage difference when the clock controller does not detect said external clock signal or when the clock controller detects said external clock signal is abnormal; and said shutoff switching circuit not controlling said power converter.

2. The liquid crystal display device according to claim 1, wherein said first control voltage is equal to said second working voltage.

3. The liquid crystal display device according to claim 1, wherein said second control voltage is of zero volts.

4. The liquid crystal display device according to claim 1, wherein said gamma voltage generator receives said first control voltage and generates a first reference voltage, or receives said second control voltage and generates a second reference voltage.

5. The liquid crystal display device according to claim 4, wherein said common voltage circuit receives said first control voltage and generates a first common voltage, or receives said second control voltage and generates a second common voltage.

6. The liquid crystal display device according to claim 5, wherein said second reference voltage is equal to said second common voltage.

7. The liquid crystal display device according to claim 5, wherein both said second reference voltage and said second common voltage are of zero volts.

8. The liquid crystal display device according to claim 1, wherein said information of said switching signal is one of a first level voltage and a second level voltage; when said switching signal is at said first level voltage, said shutoff switching circuit generates said first control voltage; when said switching signal is at said second level voltage, said shutoff switching circuit generates said second control voltage; said first level voltage is not equal to said second level voltage.

9. The liquid crystal display device according to claim 8, wherein said clock controller changes said switching signal to said first level voltage when said external clock signal is input to said liquid crystal display device or when said clock controller detects said external clock signal.

10. The liquid crystal display device according to claim 8, wherein said clock controller changes said switching signal to said second level voltage when said external clock signal is no more inputted to said liquid crystal display device or when said clock controller does not detect said external clock signal or when said clock controller detects said external clock signal is abnormal.

11. The liquid crystal display device according to claim 8, wherein after no said external clock signal has been input to said liquid crystal display device for a first time interval or after said clock controller has detected no said external clock signal for said first time interval or has detected said external clock signal is abnormal for said first time interval, said clock controller changes said switching signal to said second level voltage and maintains said switching signal at said second level voltage for a second time interval.

12. The liquid crystal display device according to claim 11, wherein after said second level voltage has been maintained for said second time interval, said power converter stops providing said first working voltage and said second working voltage.

13. The liquid crystal display device according to claim 11, wherein said first time interval is equal to a time interval for scanning two scan lines.

14. The liquid crystal display device according to claim 11, wherein said second time interval is greater than a time interval for scanning a frame.

15. The liquid crystal display device according to claim 1, wherein said shutoff switching circuit is integrated into said power converter.

16. The liquid crystal display device according to claim 4, wherein said gamma voltage generator generates one of said first reference voltage and said second reference voltage to a source driver to make said source driver generate a gray-level voltage to a corresponding pixel electrode.

17. The liquid crystal display device according to claim 16, wherein said second control voltage is of zero volts, and said gray-level voltage is also of zero volts.

18. The liquid crystal display device according to claim 1, wherein said external clock signal is contained by LVDS (Low Voltage Differential Signal), RSDS (Reduced Swing Differential Signal), or a TTL (Transistor-Transistor Logic) signal.

* * * * *